United States Patent [19]

Mori

[11] Patent Number: 4,466,322

[45] Date of Patent: Aug. 21, 1984

[54] PUNCH FOR OFFICE USE

[75] Inventor: Chuzo Mori, Katsushika, Japan

[73] Assignee: Carl Manufacturing Co., Ltd., Tokyo, Japan

[21] Appl. No.: 393,889

[22] Filed: Jul. 1, 1982

[51] Int. Cl.[3] ..... B26F 1/02

[52] U.S. Cl. ..... 83/468; 83/588; 83/618; 83/640; 83/698

[58] Field of Search ..... 83/467, 468, 522, 588, 83/618, 633, 640, 698

[56] References Cited

U.S. PATENT DOCUMENTS

| | | | |
|---|---|---|---|
| 1,759,672 | 5/1930 | Tellier | 83/618 X |
| 2,149,268 | 3/1939 | Brennan | 83/468 |
| 2,328,558 | 9/1943 | Kipp | 83/618 X |
| 2,405,150 | 8/1946 | Kern | 83/618 |
| 3,714,857 | 2/1973 | Stuertz et al. | 83/468 |

*Primary Examiner*—Frank T. Yost

*Attorney, Agent, or Firm*—Parkhurst & Oliff

[57] ABSTRACT

The present invention relates to a punch for office use for making a pair of holes at first or second predetermined spaced apart distances in a card, or like paper to be punched by a pair of punching blades. A pair of right and left blade supporting members each support a punching blade. Each of the punching blades has a longitudinal axis that deviates from the longitudinal axis of the blade supporting member. A punch for either narrow or wide punching can be manufactured by changing the right and left positions of the pair of right and left punching blade supporting members.

6 Claims, 14 Drawing Figures

FIG. 4
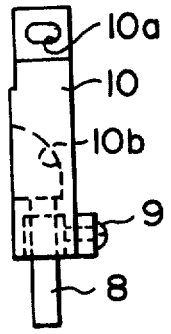
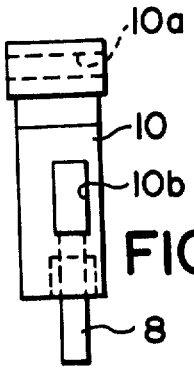
FIG. 5
FIG. 6
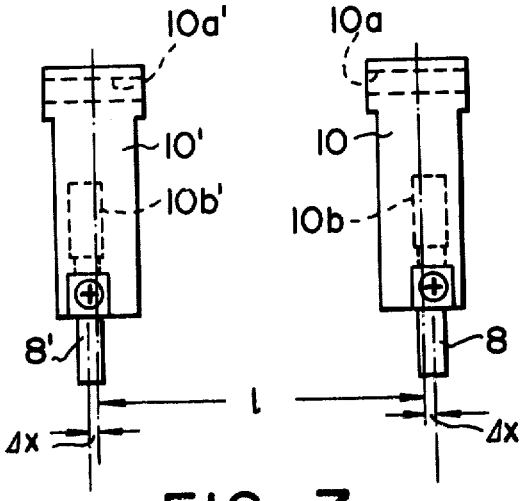
FIG. 7
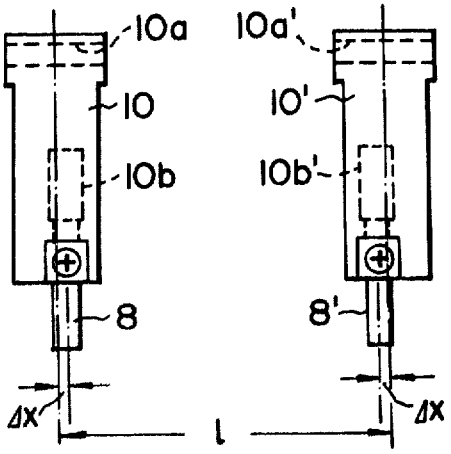

PUNCH FOR OFFICE USE

BACKGROUND OF THE INVENTION

1. Field of the Invention:

This invention relates to an improved punch for office use.

2. Description of the Prior Art:

There is known a punch for office use having a pair of punching blades adapted to make a pair of holes having a fixed distance therebetween in a card, or like paper when a handle is pressed down. In the majority of these punches, however, the distance between the punching blades is not adjustable. Moreover, the distance between the blades, hence between the holes thereby made, differs between a punch available in a country adopting the metric system and a punch in a country adopting the yard-pound system. The former punch is so designed as to make a pair of holes having a center-to-center distance of 8 cm, while the holes made by the latter punch have a center-to-center distance of 2¾ inches, or about 7 cm. In the conventional manufacturing steps, accordingly, conventional punches have been separately manufactured according to the distance between the holes to be punched, in which a pair of blade supporting members that fit to the desired distance are separately manufactured and a pair of punching blades are fixed thereto. For this reason, both the manufacturers and the users have always been desirous of having a punch which includes a pair of cutting blades having a distance therebetween which can easily be varied if only some of its parts are changed.

SUMMARY OF THE INVENTION

It is a principal object of this invention to provide a punch for office use which can make a pair of holes having an adjustable distance therebetween. This object of the invention is attained by a punch having a pair of separate, interchangeable blade supporting members provided at right and left lined side each carrying a punching blade thereon in such a way that it may have a center deviating from the blade supporting member. If the blade supporting members are interchanged their right and left side positions, there are formed a pair of holes having a different distance therebetween.

Other objects and advantages of this invention will become apparent from the following detailed description, and the accompanying drawings.

BRIEF DESCRIPTION OF THE DRAWINGS

FIG. 4 is a side elevational view of a blade supporting member;

FIG. 5 is a rear view of the blade supporting member shown in FIG. 4;

FIG. 6 is a front elevational view showing a pair of blade supporting members in a mutually spaced apart relationship, in FIG. 6;

FIG. 7 is a view similar to FIG. 6, but showing the blade supporting members in a different spaced apart relationship from that shown in FIG. 6;

This invention relates to a punch for office use. In a preferred embodiment, the punch comprises a base and a pair of first and second hollow upright members which are spaced apart at a predetermined distance on the base. A part of the upright members is spaced above the base to define a gap therebetween. A handle is vertically rotatably supported on the upright members by first pins, and a pair of first and second vertically movable blade supporting members are inserted in the first and second upright members, respectively. The blade supporting members are supported at their tops by second pins to the handle so that the members are vertically movable in response to the vertical rotation of the handle. A pair of hollow punching blades protrude at the lower sides of the pair of blade supporting members. Each of the punching blades has a longitudinal axis deviating from the longitudinal axis of the blade supporting member so that a punching distance can be changed from a first punching distance to a second punching distance by interchanging the positions of the first and second blade supporting members.

The blades communicate through their upper ends with a pair of cavities, each of which has one end in the corresponding blade supporting member and the other end opening in the corresponding upright member so that waste paper is passed through the inside of each blade supporting member. A pair of supporting plates are provided on the base at the lower position of the pair of punching blades for punching a card, paper and so on. One face of each of the supporting plates cooperates with the corresponding punching blade at both first and second punching distances in such a manner that the supporting plates receive the top ends of the punching blades which are lowered in response to the vertical rotation of the handle through the gap between the base and the upright members.

The invention will now be described merely by way of example with reference to the drawings.

Figure 1:
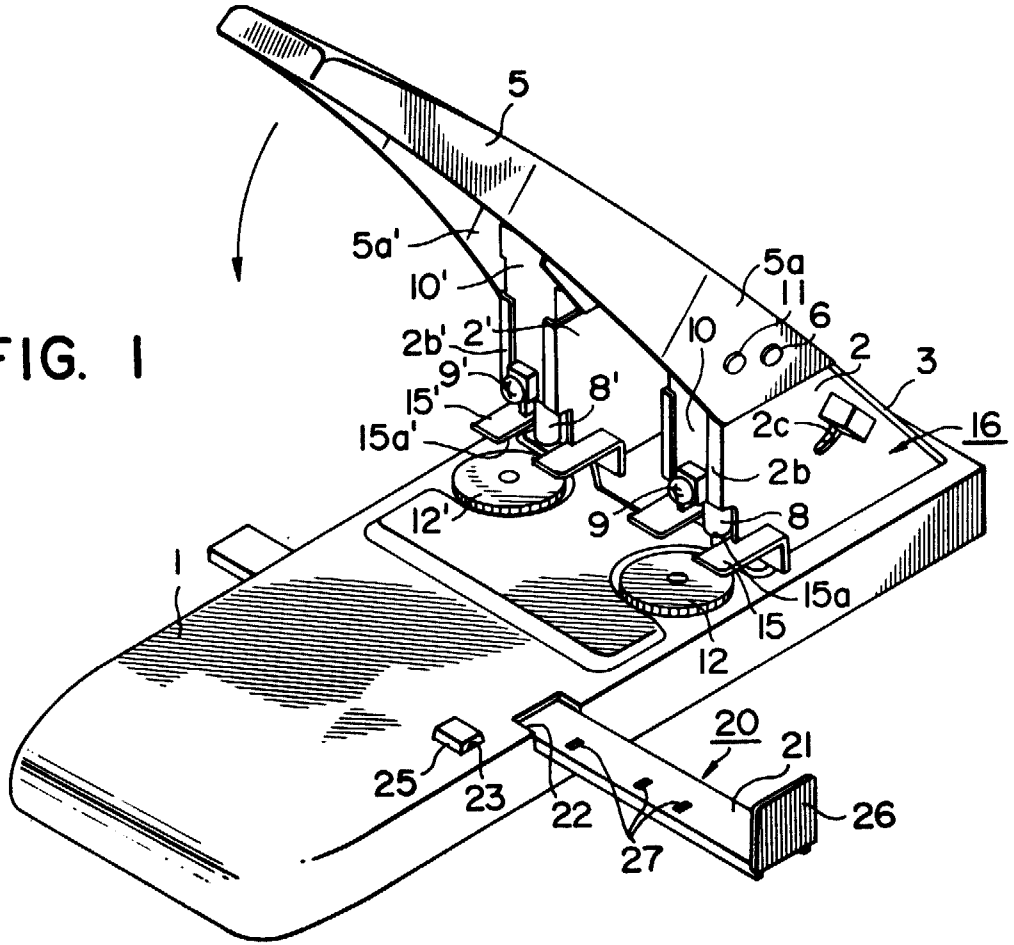
FIG. 1 is a perspective view of a punch embodying this invention.
Figure 2:
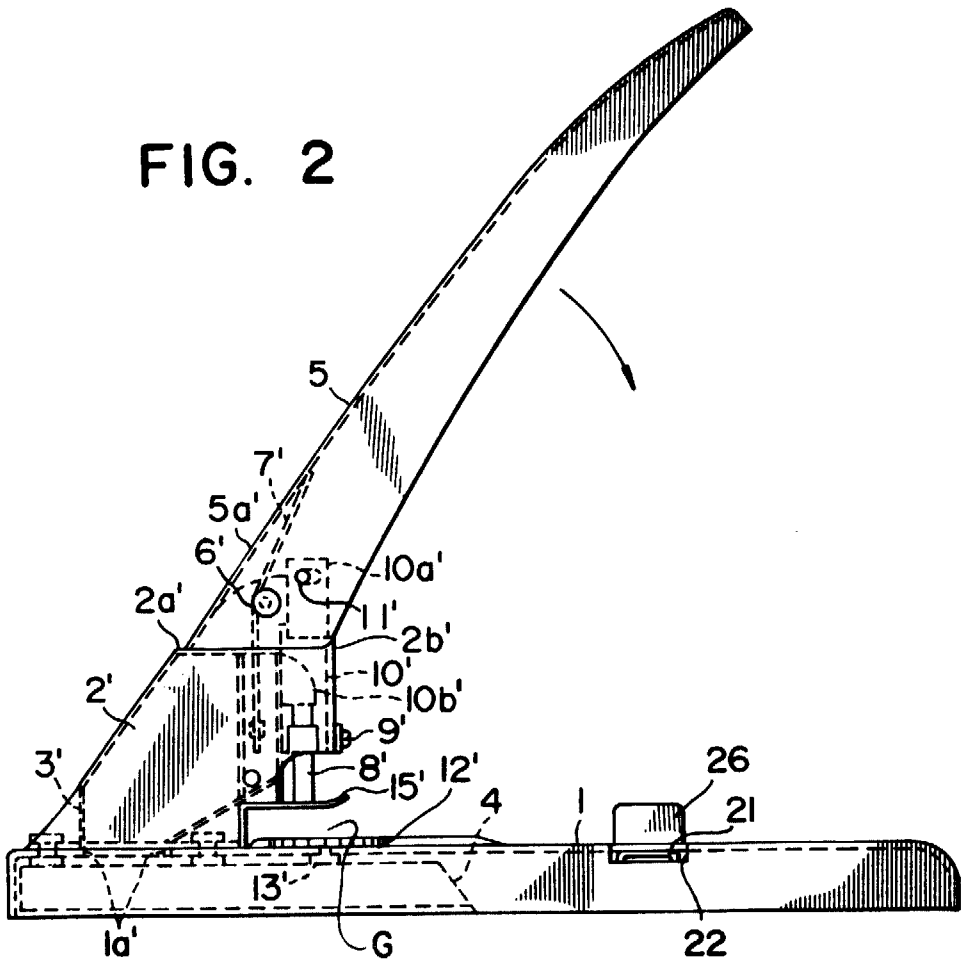
FIG. 2 is a left side elevational view of the punch shown in FIG. 1.
Figure 3:
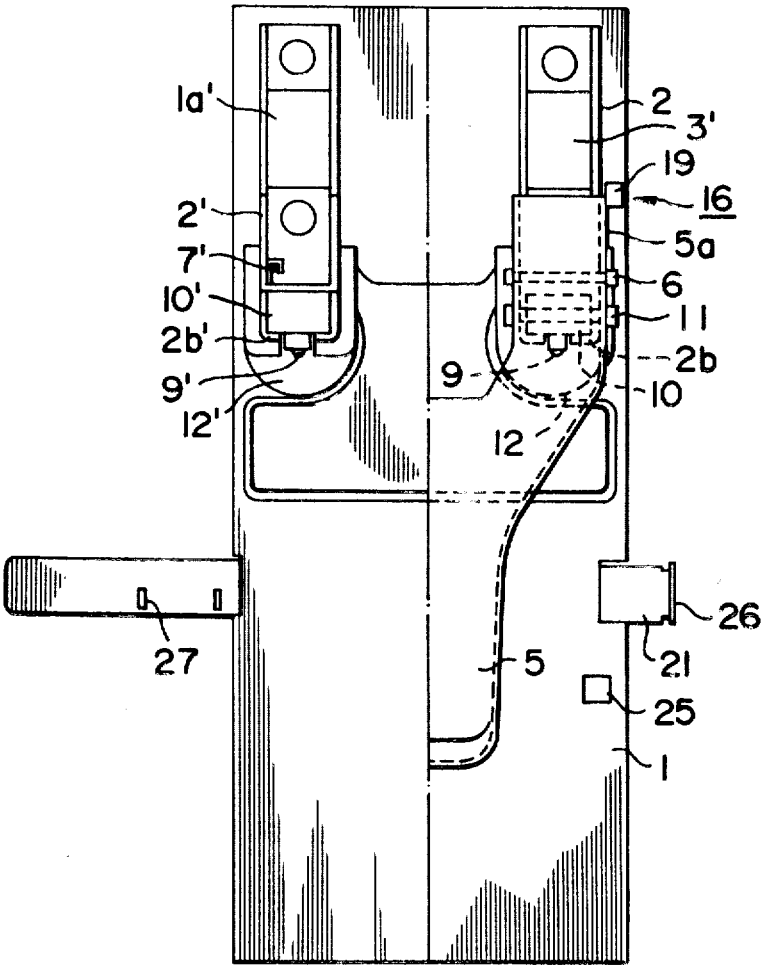
FIG. 3 is a fragmentary top plan view of the punch shown in FIG. 1.

Referring first to FIGS. 1 to 3 of the drawings, there is shown a punch for office use embodying this invention. The punch includes a number of symmetrically disposed pairs of parts. In the drawings, each pair of parts are distinguished from each other by an apostrophe attached to one of those parts so that no repeated description may be required thereon.

The punch shown in FIGS. 1 to 3 includes a base member 1, and a pair of spaced apart upright members 2 and 2' provided on the base member 1 adjacent to the rear end thereof. A part of the upright members 2 and 2' are spaced from the base to define a gap G therbetween. The upright members 2 and 2' are hollow, and accommodate therein receptacles 3 and 3', respectively, for waste paper. A waste tray 4 is removably provided on the underside of the base member 1, and the base member 1 has a pair of holes 1a and 1a' through which waste paper is transferred from the receptacles 3 and 3' to the waste tray 4.

A handle 5 is generally V-shaped in top plan, and has a pair of inwardly bent side portions 5a and 5a'. The handle 5 is vertically rotatably supported on the upright members 2 and 2' by pins 6 and 6', and is normally urged towards its raised position by springs 7 and 7' placed about the pins 6 and 6', respectively. The upright members 2 and 2' have upper ends 2a and 2a' which define stops for the rear ends of the side portions 5a and 5a' of the handle 5 to prevent any further upward rotation of the handle 5.

A pair of blade supporting members 10 and 10' are disposed inwardly of the side portions 5a and 5a' of the handle 5, and a pair of punching blades 8 and 8' are carried on the lower ends of the blade supporting members 10 and 10', respectively. Screws 9, 9' may be provided to locate the punching blades 8, 8' in the blade supporting members 10, 10'. The blade supporting members 10 and 10' have elongated holes 10a and 10a', respectively, adjacent to their upper ends, and are supported on the handle 5 by pins 11 and 11' received freely in the elongated holes 10a and 10a', respectively. The blade supporting members 10 and 10', which are more specifically shown in FIGS. 4 to 7, are received in guide members 2b and 2b' forming integral portions of the upright members 2 and 2', respectively, and are vertically movable along the guide members 2b and 2b' when the handle 5 is rotated.

The punching blades 8 and 8' are cylindrical, and each have a tapered lower end defining a round cutting edge in its inner peripheral face. Each of the punching blades 8 and 8' has a longitudinal axis deviating from the longitudinal axis (center line) of the blade supporting member 10 or 10' by a certain distance as indicated at $\Delta\times$in FIGS. 6 and 7. Accordingly, the distance between the longitudinal axes of the blades 8 and 8' can be varied if the blade supporting members 10 and 10' are reversed in the right and left positions, while the distance l between the longitudinal axes of the supporting members 10 and 10' is maintained unchanged. In the arrangement shown in FIG. 6, the longitudinal axes of the blades 8 and 8' have a distance therebetween which is longer by a distance equal to four times $\Delta\times$than in FIG. 7.

Each of the blade supporting members 10 and 10' has a cavity 10b or 10b'. Each of the cavities 10b and 10b' has one open end facing the upper end of the punching blade 8 or 8', while another open end of the cavity 10b or 10b' faces the hollow interior of the upright member 2 or 2'.

Figure 8:
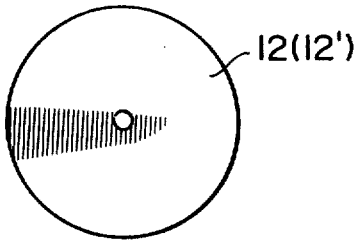
FIG. 8 is a top plan view of a supporting plate.
Figure 10:
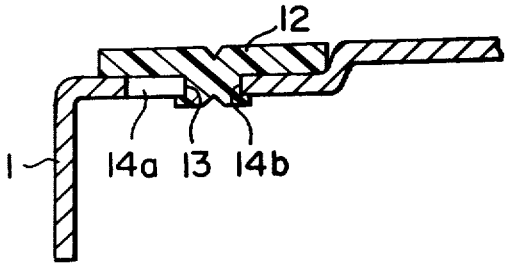
FIG. 10 is a fragmentary sectional view showing a supporting plate received in a hole in the base.
Figure 9:
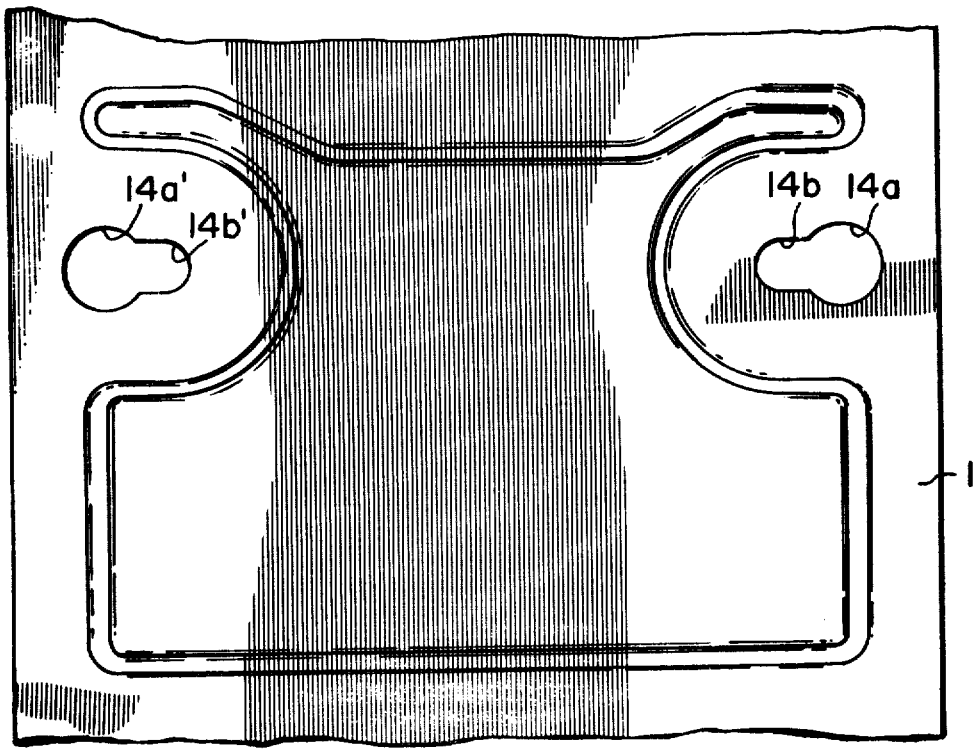
FIG. 9 is a fragmentary top plan view showing holes formed in a base for receiving supporting plates.

A pair of supporting plates 12 and 12' are provided on the base member 1, and face the punching blades 8 and 8', respectively. Each of the supporting plates 12 and 12' is a disk (see FIG. 8) having a hardness which is slightly lower than that of the cutting edge on the blade 8 or 8', but which is sufficiently high to exert pressure on the paper to be punched. Each disk has a notched peripheral edge, and is provided in the center of its bottom with a projection 13 or 13' having an enlarged diameter at its lower end, as shown in FIG. 10. The base member 1 has a pair of holes in which the supporting plates 12 and 12' are mounted. Each hole is formed by a hole segment 14a or 14a' through which the enlarged end of the projection 13 or 13' on the supporting plate 12 or 12' can be passed, and a smaller hole segment 14b or 14b' which is contiguous to the hole segment 14a or 14a', and in which the projection 13 or 13' moved to the smaller segment 14a or 14a' is held so that the supporting plate 12 or 12' may be rotatable. If the supporting plates 12 and 12' are damaged or worn on their surfaces after a long period of use, they can be rotated about their projections 13 and 13' so that their unworn surface portions may face the cutting edges. The arrangement hereinabove described also facilitates changing of the supporting disks to new ones.

A pair of paper holding members 15 and 15' prevent upward deflection of the paper to be punched, and also of the paper after it has been punched. Each of the paper holding members 15 and 15' has a recess 15a or 15a' through which the punching blade 8 or 8' is vertically movable.

Figure 11:
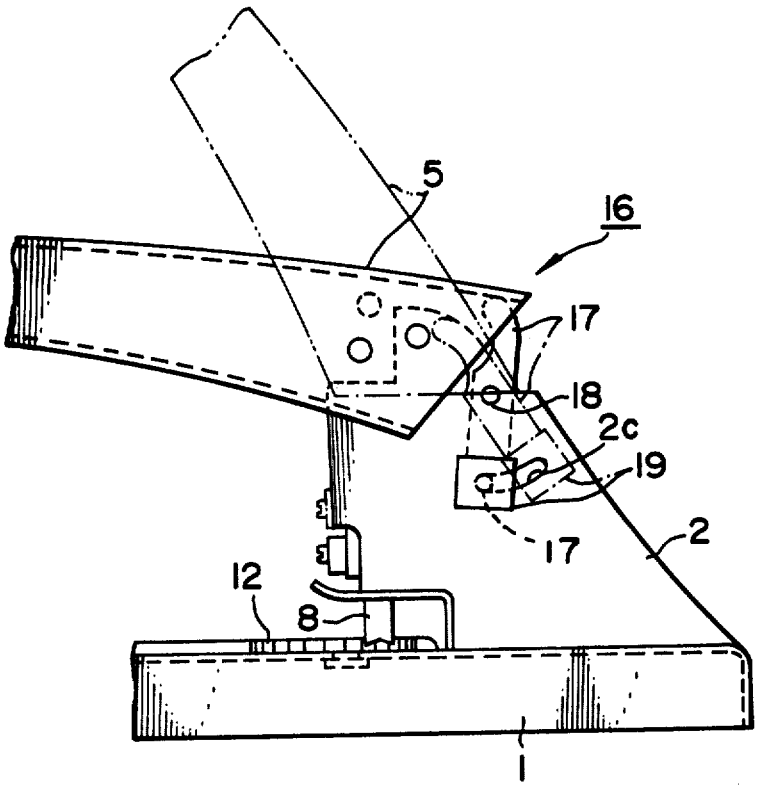
FIG. 11 is a fragmentary right side elevational view showing a part of the punch shown in FIG. 1.

A device 16 is provided on the upright member 2 for maintaining the handle 5 in a substantially horizontal position when the punching blades 8 and 8' have been lowered. The handle retaining device 16 comprises a lever member 17 disposed in the upright member 2, and having in its midportion an integral pin 18 supported rotatably on the upper end of the upright member 2, as shown in FIG. 11. The lever member 17 is also provided at its lower end with a laterally extending pin 17a received freely in a slot 2c formed in the outer wall of the upright member 2. A knob 19 is provided on the outer end of the pin 17a.

When the handle 5 is in its raised position, the lever member 17 is in its inoperative position as shown by broken lines in FIG. 11. If the handle 5 is lowered to its substantially horizontal position, and if the knob 19 is pushed forward to rotate the lever member 17 to a position shown by solid lines in FIG. 11, the lever member 17 is rotated about the pin 18 clockwise in FIG. 11, and has its upper end engaged with the inner surface of the handle 5 to maintain the handle 5 in its substantially horizontal position. The handle 5 is released from the lever member 17 if the knob 19 is pushed backward. The device 16 makes it possible to maintain the handle 5 substantially in parallel to the base member 1, thereby making the punch as a whole compact when it is, for example, transported.

Figure 12:
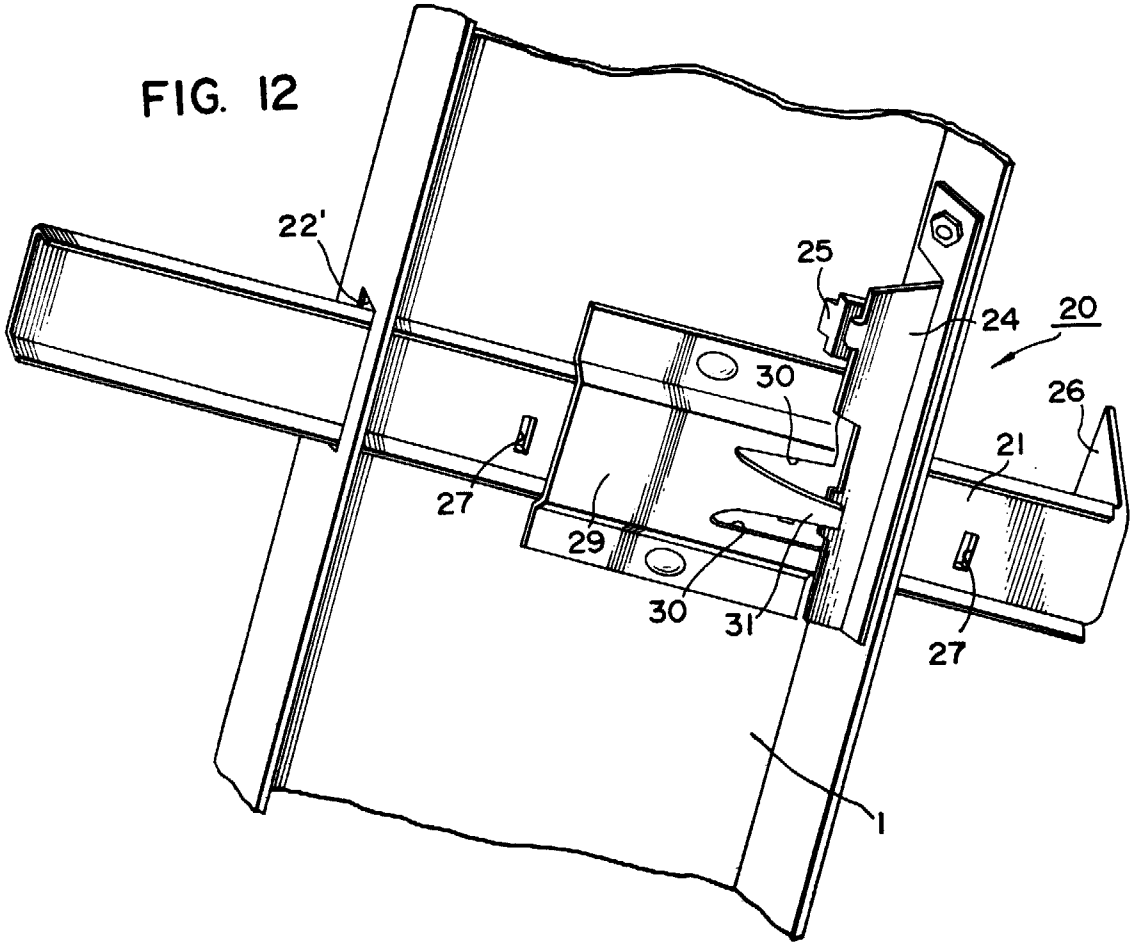
FIG. 12 is a fragmentary perspective view of the bottom of the punch shown in FIG. 1, particularly showing a device for positioning the paper to be punched.

A paper positioning member 20 comprises a positioning plate 21 extending transversely movably through a pair of holes 22 and 22' formed at the side edges of the base member 1. A stop lever 24 is provided on the underside of the base member 1, and has a button 25 which can be depressed downwardly, as shown in FIG. 12. The base member 1 has a hole 23 through which the button 25 projects upwardly.

Figure 13:
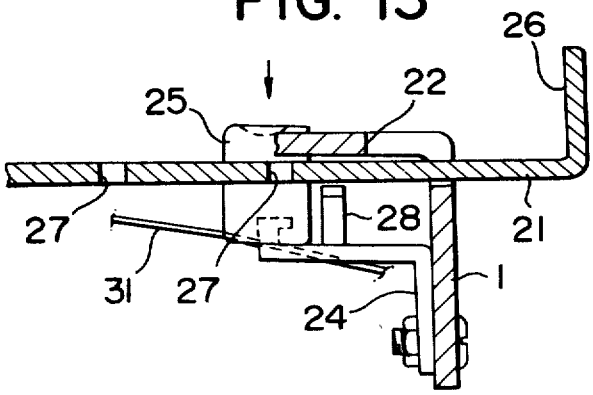
FIG. 13 is a fragmentary sectional view showing the operation of the paper positioning device shown in FIG. 12.
Figure 14:
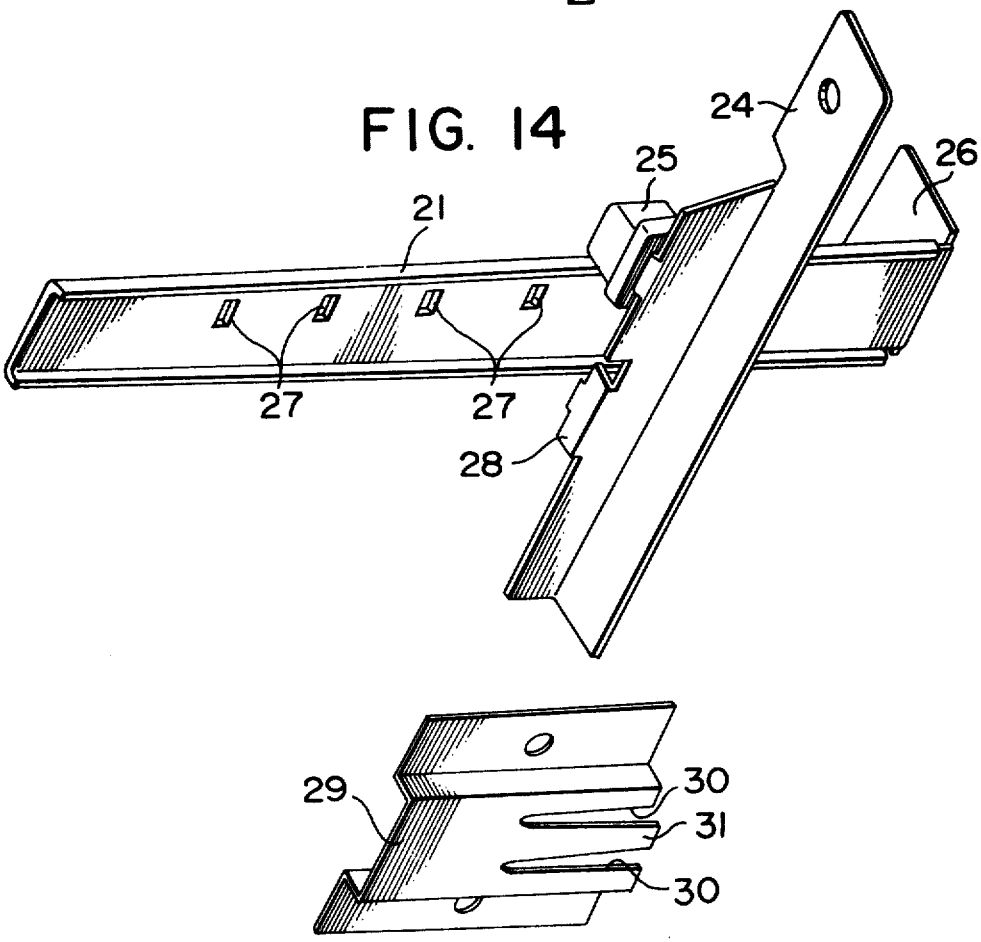
FIG. 14 is an exploded view of the paper positioning device.

Referring now more particularly to FIGS. 12 to 14, the positioning plate 21 comprises a channel-shaped metal plate having an L-shaped bend at one end thereof to define an edge support 26 for the paper to be punched. The positioning plate 21 has a plurality of spaced apart apertures 27, and the lever 24 has a projection 28 disposed below the plate 21, and which is engageable in one of the apertures 27. The lever 24, thus, defines a mechanism for locking the positioning plate 21 against movement.

The positions of the apertures 27 in the positioning plate 21 are appropriately selected to suit various paper sizes, such as B4, A4, A5 and B6, so that the paper to be punched may be accurately centered between the punching blades 8 and 8' when one edge thereof is placed in contact with the edge support 26. A leaf spring member 29 is attached to the rear surface of the base member 1, and partially encloses the positioning plate 21. A pair of slits 30 are formed at one end of the member 29 facing the lever 24, and define therebetween a retaining projection 31 of appropriate strength. The projection 31 is held against the lever 24 supported rotatably on the base member 1, and urges the lever 24 to maintain its projection 28 in engagement with one of the apertures 27 in the positioning plate 21. The positioning plate 21 facilitates positioning of the paper to be punched, since it is movable only if the button 25 is depressed to disengage the projection 28 from the apertures 27. Moreover, the positioning plate 21 is movable to any desired position to facilitate the operation of the punch when it is necessary to make more than two holes in a single sheet of paper.

In operation, the positioning plate 21 is fixed in an appropriate position suiting the size of the paper to be punched, the paper not shown is placed on the base member 1 with one edge thereof held against the edge support 26, and the handle 5 is lowered in the direction of an arrow in FIG. 1, whereby a pair of holes are punched in the paper.

When the handle 5 is lowered, the blade supporting members 10 and 10' are lowered simultaneously to press the punching blades 8 and 8' against the paper to be punched which is also pressed to the supporting plates 12 and 12', so that their cutting edges may be pierced through the paper. The blades 8 and 8' pierced through the paper have their cutting edges received by the supporting plates 12 and 12', respectively. The waste paper separated by punching is stored in the hollow interiors of the blades 8 and 8'. If the handle 5 is released from downward pressure to return to its raised position, the blade supporting members 10 and 10', and the blades 8 and 8' are also raised to their original positions, while the punched paper is retained under the paper holding members 15 and 15'.

As the foregoing sequence of operation is repeated, waste paper is gradually piled up in the blades 8 and 8', and if the blades are filled with paper waste, it drops into the receptacles 13 and 13' in the upright members 2 and 2' through the cavities **10*b* and 10*b'* in the blade supporting members 10 and 10', and then, into the waste tray 4 through the holes 1*a* and 1*a'* of the base member 1**.

With the above-mentioned construction, the present invention has the following advantages and effects:

(1) In assembling the punch for office use according to the present invention, only the spaced distance position of the pair (right and left) of blade supporting members 10, 10' is considered by positioning the right and left blade supporting members 10, 10' at either the "narrow" or "wide" distance according to narrow or wide punching.

Contrary to the conventional devices, the present invention eliminates the disadvantage that the conventional punches had to be manufactured separately according to the distance between a pair of holes to be punched, in which blade supports which fit to the desired distance are separately manufactured and a pair of blades are fixed thereto. Accordingly, the present invention has such an advantage that a punch suitable for punching narrow or wide distances can be efficiently manufactured.

(2) Further, even though the distance between the blades 8, 8' is changed during assembly of the punch, the position of the supporting plates 12, 12' is definite without the need for any change of position. In this regard, the present invention has the advantage that it can be efficiently manufactured.

(3) Moreover, in the present invention, waste paper is conveyed through the punching blades 8, 8' and then in the upright members 2, 2' to the cavities **10*b*, 10*b'* of the blade supporting members 10, 10'**, thereby efficiently eliminating waste paper.

As is obvious from the foregoing description, the punch of this invention is characterized particularly by a pair of blade supporting members each carrying a punching blade in such a way that it may have a center deviating from that of the blade supporting member, so that a pair of holes having a different distance therebetween may be formed only if the blade supporting members are reversed in position. The punch of this invention, therefore, very advantageously eliminates a lot of waste in the manufacture and use of a plurality of different punches each having a fixed and unvariable distance between the punching blades.

What is claimed is:

1. A punch for office use comprising:

a base;

a pair of first and second hollow upright members on the base and spaced apart at a predetermined distance relative to each other, a part of the upright members defining a gap between the upright members and the base;

a handle supported on the upright members by first pins for rotation in a vertical plane relative to said base;

a pair of first and second movable blade supporting members in the first and second upright members, respectively, said blade supporting members being supported at their tops by second pins to the handle, so that the blade supporting members are movable through the gap toward the base in response to the vertical rotation of the handle;

a pair of hollow punching blades protruding from the lower sides of the pair of blade supporting members, each punching blade having a longitudinal axis deviating from the longitudinal axis of the corresponding blade supporting member so that a punching distance can be changed between first and second punching distances by interchanging the positions of the first and second blade supporting members in relation to the first and second upright members, said blades communicating through their upper ends with a pair of cavities, one end of each of said cavities being in the corresponding blade supporting member and the other end opening in the corresponding upright member so that waste paper is passed through the inside of each blade supporting member; and a pair of supporting plates on the base at the lower position of the pair of punching blades, one face of each of said supporting plates cooperating with said punching blades at both the first and second punching distances in such a manner that said supporting plates receive the ends of the punching blades which move in response to the vertical rotation of a handle through the gap between the base and the upright members.

2. A punch as set forth in claim 1, wherein each of said supporting plates is provided with a projection on its underside, and wherein said base member has a pair of holes in which said projections of said supporting plates are mounted removably and rotatably, each of said holes being formed by two hole segments joined together to define a single hole, one of said segments being sufficiently large to enable passage of said projection of one of said supporting plates, while the other segment is sufficiently small to retain said projection rotatably.

3. A punch as set forth in claim 1 or 2, further including a paper positioning member provided transversely of said base member at the forward side from the first and second upright members, and having a plurality of spaced apart apertures, said positioning member being movable transversely of said base member, and a lever having a projection which is engageable in one of said apertures, said lever being normally urged by a spring so that said projection thereof may be maintained in engagement with said one aperture, said lever also having a button which can be depressed to disengage said projection from said aperture to permit movement of said positioning member.

4. A punch as set forth in claim 3, wherein said spring is a leaf spring having a projection held against said lever to urge said projection thereof into engagement with said aperture.

5. A punch as set forth in claim 1, wherein said handle is generally V-shaped in top plan.

6. A punch as set forth in claim 1, further including a means provided on said base member for retaining said handle substantially in parallel to said base member.

* * * * *